US009927748B2

(12) United States Patent
Yoshinaga et al.

(10) Patent No.: US 9,927,748 B2
(45) Date of Patent: Mar. 27, 2018

(54) FIXING DEVICE AND IMAGE FORMING APPARATUS

(71) Applicants: Hiroshi Yoshinaga, Chiba (JP); Masahiko Satoh, Tokyo (JP); Masaaki Yoshikawa, Tokyo (JP); Kenji Ishii, Kanagawa (JP); Tadashi Ogawa, Tokyo (JP); Hiromasa Takagi, Tokyo (JP); Naoki Iwaya, Tokyo (JP); Takuya Seshita, Kanagawa (JP); Takahiro Imada, Kanagawa (JP); Hajime Gotoh, Kanagawa (JP); Akira Suzuki, Tokyo (JP); Teppei Kawata, Kanagawa (JP); Toshihiko Shimokawa, Kanagawa (JP); Arinobu Yoshiura, Kanagawa (JP); Takamasa Hase, Shizuoka (JP); Takeshi Uchitani, Kanagawa (JP); Shuutaroh Yuasa, Kanagawa (JP); Kensuke Yamaji, Kanagawa (JP)

(72) Inventors: Hiroshi Yoshinaga, Chiba (JP); Masahiko Satoh, Tokyo (JP); Masaaki Yoshikawa, Tokyo (JP); Kenji Ishii, Kanagawa (JP); Tadashi Ogawa, Tokyo (JP); Hiromasa Takagi, Tokyo (JP); Naoki Iwaya, Tokyo (JP); Takuya Seshita, Kanagawa (JP); Takahiro Imada, Kanagawa (JP); Hajime Gotoh, Kanagawa (JP); Akira Suzuki, Tokyo (JP); Teppei Kawata, Kanagawa (JP); Toshihiko Shimokawa, Kanagawa (JP); Arinobu Yoshiura, Kanagawa (JP); Takamasa Hase, Shizuoka (JP); Takeshi Uchitani, Kanagawa (JP); Shuutaroh Yuasa, Kanagawa (JP); Kensuke Yamaji, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 13/751,648

(22) Filed: Jan. 28, 2013

(65) Prior Publication Data

US 2013/0195525 A1 Aug. 1, 2013

(30) Foreign Application Priority Data

Jan. 31, 2012 (JP) ..... 2012-017929
Sep. 28, 2012 (JP) ..... 2012-216290

(51) Int. Cl.
*G03G 15/20* (2006.01)

(52) U.S. Cl.
CPC ..... *G03G 15/2064* (2013.01); *G03G 15/2053* (2013.01); *G03G 2215/2035* (2013.01)

(58) Field of Classification Search
CPC ..... G03G 15/2064; G03G 15/2089
(Continued)

(56) References Cited

U.S. PATENT DOCUMENTS 6,263,172 B1 * 7/2001 Suzuki et al. ..... 399/67
6,671,470 B2 * 12/2003 Suzuki ..... G03G 15/2039 399/328

(Continued)

FOREIGN PATENT DOCUMENTS

JP 2004-053618 2/2004
JP 2004-286922 10/2004

(Continued)

OTHER PUBLICATIONS

Bello et al (Strength and Stiffness of Engineering Systems, 2009 Springer Science+Business Media, e-ISBN: 978-0-387-49474-6, pp. 208-209, 213, and 217).*

(Continued)

*Primary Examiner* — Clayton E LaBalle
*Assistant Examiner* — Leon W Rhodes, Jr
(74) *Attorney, Agent, or Firm* — Oblon, McClelland, Maier & Neustadt, L.L.P.

(57) ABSTRACT

A fixing device includes: a rotatable endless fixing belt; a nip forming member arranged inside the fixing belt; a facing (Continued)

rotating body that abuts the nip forming member via the fixing belt to form a nip portion with the fixing belt; a heat source that directly heats up the fixing belt at a portion other than the nip portion; and a supporting member that supports the nip forming member. The fixing device conveys a recording medium carrying an unfixed image to the nip portion to fix the unfixed image to the recording medium, and the supporting member includes a rising portion extending in an abutting direction of the facing rotating body against the fixing belt and having a tip close to an inner circumferential surface of the fixing belt, and is set to have a section modulus of 200 $mm^3$ or higher.

49 Claims, 7 Drawing Sheets

(58) Field of Classification Search
USPC ..... 399/329
See application file for complete search history.

(56) References Cited

U.S. PATENT DOCUMENTS

| | | | | |
|---|---|---|---|---|
| 6,895,207 | B2 * | 5/2005 | Kataoka | G03G 15/2053 399/328 |
| 7,242,895 | B2 * | 7/2007 | Inada | G03G 15/2053 219/216 |
| 7,437,110 | B2 | 10/2008 | Kondo et al. | |
| 7,885,590 | B2 | 2/2011 | Seo et al. | |
| 2004/0184848 | A1 | 9/2004 | Oonishi | |
| 2006/0029411 | A1 | 2/2006 | Ishii et al. | |
| 2007/0189818 | A1 | 8/2007 | Kondo et al. | |
| 2007/0212089 | A1 | 9/2007 | Seo et al. | |
| 2007/0280754 | A1 | 12/2007 | Ogawa et al. | |
| 2007/0292175 | A1 | 12/2007 | Shinshi | |
| 2008/0025772 | A1 | 1/2008 | Seo et al. | |
| 2008/0025773 | A1 | 1/2008 | Ito et al. | |
| 2008/0175633 | A1 | 7/2008 | Shinshi | |
| 2008/0219721 | A1 | 9/2008 | Ito et al. | |
| 2008/0219730 | A1 | 9/2008 | Shinshi | |
| 2008/0226326 | A1 | 9/2008 | Seo et al. | |
| 2008/0232873 | A1 | 9/2008 | Ueno et al. | |
| 2008/0298862 | A1 * | 12/2008 | Shinshi | 399/324 |
| 2009/0123201 | A1 | 5/2009 | Ehara et al. | |
| 2009/0148205 | A1 | 6/2009 | Seo et al. | |
| 2009/0245865 | A1 | 10/2009 | Shinshi et al. | |
| 2009/0245897 | A1 | 10/2009 | Seo et al. | |
| 2009/0297197 | A1 | 12/2009 | Hase | |
| 2010/0061753 | A1 | 3/2010 | Hase | |
| 2010/0074667 | A1 | 3/2010 | Ehara et al. | |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |
| 2010/0290822 | A1 | 11/2010 | Hasegawa et al. | |
| 2010/0303521 | A1 | 12/2010 | Ogawa et al. | |
| 2011/0020018 | A1 * | 1/2011 | Takenaka | G03G 15/2053 399/33 |
| 2011/0026988 | A1 | 2/2011 | Yoshikawa et al. | |
| 2011/0044706 | A1 | 2/2011 | Iwaya et al. | |
| 2011/0044734 | A1 | 2/2011 | Shimokawa et al. | |
| 2011/0052237 | A1 | 3/2011 | Yoshikawa et al. | |
| 2011/0052245 | A1 | 3/2011 | Shinshi et al. | |
| 2011/0052277 | A1 | 3/2011 | Ueno et al. | |
| 2011/0052282 | A1 | 3/2011 | Shinshi et al. | |
| 2011/0058862 | A1 | 3/2011 | Yamaguchi et al. | |
| 2011/0058863 | A1 | 3/2011 | Shinshi et al. | |
| 2011/0058864 | A1 | 3/2011 | Fujimoto et al. | |
| 2011/0058865 | A1 | 3/2011 | Tokuda et al. | |
| 2011/0058866 | A1 | 3/2011 | Ishii et al. | |
| 2011/0064437 | A1 | 3/2011 | Yamashina et al. | |
| 2011/0064443 | A1 | 3/2011 | Iwaya et al. | |
| 2011/0064450 | A1 | 3/2011 | Ishii et al. | |
| 2011/0064490 | A1 | 3/2011 | Imada et al. | |
| 2011/0064502 | A1 | 3/2011 | Hase et al. | |
| 2011/0070003 | A1 | 3/2011 | Shinshi | |
| 2011/0076071 | A1 | 3/2011 | Yamaguchi et al. | |
| 2011/0085815 | A1 | 4/2011 | Kishi et al. | |
| 2011/0085832 | A1 | 4/2011 | Hasegawa et al. | |
| 2011/0091253 | A1 | 4/2011 | Seo et al. | |
| 2011/0116848 | A1 | 5/2011 | Yamaguchi et al. | |
| 2011/0129268 | A1 | 6/2011 | Ishii et al. | |
| 2011/0150518 | A1 | 6/2011 | Hase et al. | |
| 2011/0170917 | A1 | 7/2011 | Yoshikawa et al. | |
| 2011/0176821 | A1 | 7/2011 | Hase | |
| 2011/0176822 | A1 | 7/2011 | Ishii et al. | |
| 2011/0182634 | A1 | 7/2011 | Ishigaya et al. | |
| 2011/0182638 | A1 | 7/2011 | Ishii et al. | |
| 2011/0194870 | A1 | 8/2011 | Hase et al. | |
| 2011/0200368 | A1 | 8/2011 | Yamaguchi et al. | |
| 2011/0200370 | A1 | 8/2011 | Ikebuchi et al. | |
| 2011/0206427 | A1 | 8/2011 | Iwaya et al. | |
| 2011/0211876 | A1 | 9/2011 | Iwaya et al. | |
| 2011/0217056 | A1 | 9/2011 | Yoshinaga et al. | |
| 2011/0217057 | A1 * | 9/2011 | Yoshinaga et al. | 399/33 |
| 2011/0217093 | A1 | 9/2011 | Tokuda et al. | |
| 2011/0217095 | A1 | 9/2011 | Ishii et al. | |
| 2011/0222875 | A1 | 9/2011 | Imada et al. | |
| 2011/0222876 | A1 | 9/2011 | Yuasa et al. | |
| 2011/0222888 | A1 | 9/2011 | Ikebuchi et al. | |
| 2011/0222929 | A1 | 9/2011 | Fujimoto et al. | |
| 2011/0222930 | A1 | 9/2011 | Fujimoto et al. | |
| 2011/0222931 | A1 | 9/2011 | Shinshi et al. | |
| 2011/0229162 | A1 | 9/2011 | Ogawa et al. | |
| 2011/0229178 | A1 | 9/2011 | Ogawa et al. | |
| 2011/0229181 | A1 | 9/2011 | Iwaya et al. | |
| 2011/0229200 | A1 | 9/2011 | Yamaguchi et al. | |
| 2011/0229225 | A1 | 9/2011 | Ishii et al. | |
| 2011/0229226 | A1 | 9/2011 | Tokuda et al. | |
| 2011/0229227 | A1 * | 9/2011 | Yoshikawa | G03G 15/2064 399/329 |
| 2011/0229228 | A1 | 9/2011 | Yoshikawa et al. | |
| 2011/0229236 | A1 | 9/2011 | Ehara et al. | |
| 2011/0274453 | A1 | 11/2011 | Shimokawa et al. | |
| 2011/0286758 | A1 | 11/2011 | Yoshinaga | |
| 2011/0293309 | A1 | 12/2011 | Hase | |
| 2011/0311284 | A1 | 12/2011 | Seo et al. | |
| 2012/0008971 | A1 * | 1/2012 | Lee et al. | 399/69 |
| 2012/0045226 | A1 | 2/2012 | Hase et al. | |
| 2012/0051766 | A1 | 3/2012 | Ueno et al. | |
| 2012/0051774 | A1 | 3/2012 | Ikebuchi et al. | |
| 2012/0093531 | A1 | 4/2012 | Yuasa et al. | |
| 2012/0093551 | A1 | 4/2012 | Ogawa et al. | |
| 2012/0107005 | A1 | 5/2012 | Hase et al. | |
| 2012/0114345 | A1 | 5/2012 | Fujimoto et al. | |
| 2012/0114354 | A1 | 5/2012 | Saito et al. | |
| 2012/0121303 | A1 | 5/2012 | Takagi et al. | |
| 2012/0121304 | A1 | 5/2012 | Tokuda et al. | |
| 2012/0121305 | A1 | 5/2012 | Yoshikawa et al. | |
| 2012/0148303 | A1 | 6/2012 | Yamaguchi et al. | |
| 2012/0155935 | A1 | 6/2012 | Yoshikawa et al. | |
| 2012/0155936 | A1 | 6/2012 | Yamaguchi et al. | |
| 2012/0177388 | A1 | 7/2012 | Imada et al. | |
| 2012/0177393 | A1 | 7/2012 | Ikebuchi et al. | |
| 2012/0177420 | A1 | 7/2012 | Shimokawa et al. | |
| 2012/0177423 | A1 | 7/2012 | Imada et al. | |
| 2012/0177424 | A1 | 7/2012 | Saito et al. | |
| 2012/0207523 | A1 | 8/2012 | Ueno et al. | |
| 2012/0219312 | A1 | 8/2012 | Yuasa et al. | |
| 2012/0224878 | A1 | 9/2012 | Ikebuchi et al. | |
| 2012/0237273 | A1 | 9/2012 | Yoshinaga et al. | |
| 2013/0170879 | A1 * | 7/2013 | Yoshinaga et al. | 399/329 |

FOREIGN PATENT DOCUMENTS

| | | |
|---|---|---|
| JP | 2007-233011 | 9/2007 |
| JP | 2007-334205 | 12/2007 |
| JP | 2008-158482 | 7/2008 |
| JP | 2008-216928 | 9/2008 |
| JP | 2009-3410 A | 1/2009 |
| JP | 2010-079309 | 4/2010 |

(56) References Cited

FOREIGN PATENT DOCUMENTS

| | | |
|---|---|---|
| JP | 2011-059387 | 3/2011 |
| JP | 2011-186307 | 9/2011 |
| JP | 2011-186397 | 9/2011 |

OTHER PUBLICATIONS

U.S. Appl. No. 13/557,841, filed Jul. 25, 2012, Toshihiko Shimokawa, et al.
U.S. Appl. No. 13/717,046, filed Dec. 17, 2012, Iwaya, et al.
Office Action dated Jun. 14, 2016 in Japanese Patent Application No. 2012-216290.

* cited by examiner

FIXING DEVICE AND IMAGE FORMING APPARATUS

CROSS-REFERENCE TO RELATED APPLICATIONS

The present application claims priority to and incorporates by reference the entire contents of Japanese Patent Application No. 2012-017929 filed in Japan on Jan. 31, 2012 and Japanese Patent Application No. 2012-216290 filed in Japan on Sep. 28, 2012.

BACKGROUND OF THE INVENTION

1. Field of the Invention

The present invention relates to a fixing device and an image forming apparatus, and more particularly, to a belt fixing mechanism that uses a belt as a fixing member.

2. Description of the Related Art

As is well known, an electrophotographic image forming apparatus outputs a copy image by the following processes.

That is, a latent image formed on a photosensitive element that is a latent image carrier is processed to be visualized by toner, and the toner image is transferred onto a recording medium such as a recording sheet and then fixed to the recording medium, whereby the copy image is output.

A fixing method used in an image forming apparatus includes a heat roller fixing method, a belt fixing method, a film fixing method, and an electromagnetic induction heating fixing method.

In the heat roller fixing method, used are a fixing roller and a pressing roller that face each other across a conveying path of a recording sheet and abut each other. In this method, a toner image melts and permeates the recording sheet by the action of heat from a heat source provided inside the fixing roller and a pressure corresponding to the pressure applied from the pressing roller. The phenomenon that the toner image melts and permeates the recording sheet is the same in the fixing methods using the following configurations.

In the belt fixing method, used are a fixing belt that serves as a good heat conductor in place of a fixing roller, a pressing roller, a roller on which the belt is wound, and a heat source for the belt (for example, Japanese Patent Application Laid-open No. 2004-286922).

In the film fixing method, used are a fixing belt that serves as a good heat conductor in place of a fixing roller, a pressing roller, a roller on which the belt is wound, and a heat source for the belt (for example, Japanese Patent Application Laid-open No. 2010-079309).

In the electromagnetic induction heating fixing method, used is a configuration in which a heating member is provided with an electromagnetic induction coil that improves heat generation efficiency (for example, Japanese Patent Application Laid-open No. 2004-286922).

A fixing method has the following requirements.

The requirements include to shorten a warm-up time (a time for reaching a given temperature (reload temperature) making it possible to perform a printing process), from a state of normal temperature when powered on, for example, and to shorten a first print time (a time for performing print preparation, performing printing operation and finishing discharging a sheet after a print request is received).

In a fixing device, fixing failure may occur due to the following reasons.

An image forming apparatus is capable of high-speed processing. When the number of fixing sheets per unit time, i.e., the number of sheets passing through the fixing device per unit time is increased by high-speed processing, quantity of heat supplied to a fast-moving recording sheet also needs to be increased. This is to provide the recording sheet with quantity of heat necessary for fixing conforming to the shortened time during which the recording sheet passes through the fixing device.

However, when the necessary quantity of heat is not secured at the start of continuous printing, a large drop in temperature occurs, and when a sheet passes through while the necessary quantity of heat is not reached in speed-up continuous printing, fixing failure may result.

Furthermore, due to the speeding-up of image forming apparatus, the number of sheets to pass through per unit time is increased and the necessary quantity of heat is increased. This may lead to what is known as temperature drop in which the quantity of heat is insufficient particularly at the start of continuous printing, and may lead to fixing failure when sped up.

Meanwhile, separate from the above-described fixing methods, known is a fixing method referred to as a SURF fixing method in which a ceramic heater is used.

In the SURF fixing method, used is a configuration in which only a nip portion is locally heated and other portion is not heated. In the SURF fixing method, compared with a belt-type fixing device, lowering of heat capacity and downsizing is possible, whereby a time for rising to a given temperature and the first print time can be shortened but there are following problems.

That is, in the SURF fixing method, because the portion other than the local portion are not heated, the belt is in a coldest state at the entrance of a nip for a sheet or the like, whereby fixing failure is likely to occur. Particularly, a high-speed device has the problem that fixing failure is more likely to occur because the rotation of the belt is fast and thus the heat dissipation of the belt at the portion other than the nip portion becomes large.

Accordingly, to deal with such a problem, proposed is a fixing device that can achieve good fixing performance, in a configuration using an endless belt, even when the device is mounted on a high-producing image forming apparatus (for example, Japanese Patent Application Laid-open No. 2007-334205).

The fixing device disclosed in Japanese Patent Application Laid-open No. 2007-334205 uses a configuration illustrated in FIG. 9.

The fixing device includes an endless belt 100, a pipe-shaped metal heat conductor 200 arranged inside the endless belt 100, a heat source 300 arranged inside the metal heat conductor 200, and a pressing roller 400 that abuts the metal heat conductor 200 via the endless belt 100 to form a nip portion N by which a recording sheet can be clamped and conveyed.

The endless belt 100 is rotated by the rotation of the pressing roller 400, and at this time, the metal heat conductor 200 guides the movement of the endless belt 100. Furthermore, heating the endless belt 100 by the heat source 300 inside the metal heat conductor 200 via the metal heat conductor 200 enables the whole endless belt 100 to be heated. Consequently, the first print time from a heating standby state can be shortened, and the insufficiency of quantity of heat in a high-speed rotation state can be eliminated.

However, to further improve energy saving and the first print time, it is necessary to further improve heat efficiency. Accordingly, proposed is a configuration in which an endless belt is not indirectly heated via a metal heat conductor (the member indicated by the reference numeral 200 in FIG. 9), but is directly heated (without the intervention of the metal heat conductor) (for example, Japanese Patent Application Laid-open No. 2007-233011).

FIG. 10 illustrates the configuration of a fixing device disclosed in Japanese Patent Application Laid-open No. 2007-233011.

In FIG. 10, in the fixing device, the above-described pipe-shaped metal heat conductor is removed from the inside of the endless belt 100, and in place of that, a plate-shaped nip forming member 500 is positioned to face the pressing roller 400.

This configuration allows heating up the endless belt 100 directly by the heat source 300 at the portion other than where the nip forming member 500 is arranged, thereby substantially improving the efficiency of heat transfer and thus reducing the power consumption.

As a consequence, the first print time from the heating standby state can be further shortened. Furthermore, cost reduction can be expected due to the metal heat conductor not being provided. In the fixing device, the nip forming member 500 is supported by a supporting member 600 of stainless-steel or the like to improve the strength of the nip forming member 500 against the applied pressure by the pressing roller 400.

However, in the fixing device illustrated in FIG. 10, for the purpose of reducing a heat dissipation area to further improve the heat efficiency, a belt of a small diameter of about 30 millimeters is used as the endless belt 100.

In such a configuration, the size of the supporting member 600 arranged inside the endless belt 100 tends to be small. As a result, if a sufficient strength of the nip forming member 500 cannot be achieved and the deflection of the nip forming member 500 is caused by the applied pressure of the pressing roller 400, unevenness occurs in the distribution of contact pressure or the width of the nip in the nip portion N, whereby fixing failure may occur.

In view of the situations of the above-described conventional fixing devices, there is a need to provide a fixing device configured to improve the strength of a supporting member that supports a nip forming member and to prevent the deflection of the nip forming member, and an image forming apparatus provided with the fixing device.

SUMMARY OF THE INVENTION

It is an object of the present invention to at least partially solve the problems in the conventional technology.

A fixing device includes: a rotatable endless fixing belt; a nip forming member arranged inside the fixing belt; a facing rotating body that abuts the nip forming member via the fixing belt to form a nip portion with the fixing belt; a heat source that directly heats up the fixing belt at a portion other than the nip portion; and a supporting member that supports the nip forming member. The fixing device conveys a recording medium carrying an unfixed image to the nip portion between the rotating fixing belt and the facing rotating body to fix the unfixed image to the recording medium, and the supporting member includes a rising portion extending in an abutting direction of the facing rotating body against the fixing belt and having a tip close to an inner circumferential surface of the fixing belt, and is set to have a section modulus of 200 $mm^3$ or higher.

An image forming apparatus includes a fixing device as described above.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
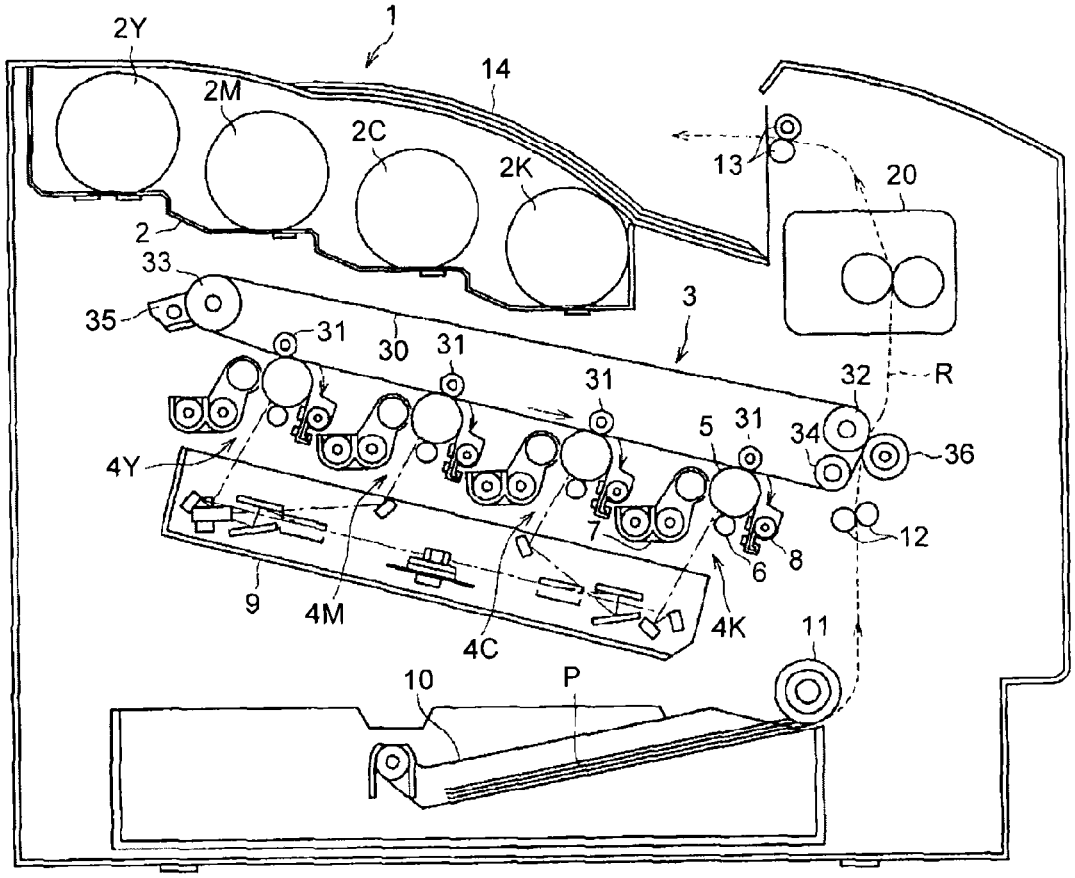
FIG. 1 is a view for explaining an image forming apparatus according to an embodiment of the present invention.

An embodiment of the present invention will be described hereinafter with reference to the accompanying drawings.

In the respective drawings for explaining the embodiments of the present invention, constituent elements such as members and components having the same function or shape are provided with the same reference numerals or symbols as long as they are recognizable, and once they are explained, redundant explanations are omitted.

With reference to FIG. 1, an overall configuration and operation of an image forming apparatus according to an embodiment of the present invention will be described first.

An image forming apparatus 1 illustrated in FIG. 1 is a color laser printer, and in the middle of a main body of the apparatus, four image forming units 4Y, 4M, 4C, and 4K are provided. The image forming units 4Y, 4M, 4C, and 4K have the same configuration except for that they house developer of different colors of yellow (Y), magenta (M), cyan (C), and black (K) that correspond to color separation components of a color image.

Specifically, each of the image forming units 4Y, 4M, 4C, and 4K includes a drum-shaped photosensitive element 5 as a latent image carrier, a charging device 6 that electrically charges the surface of the photosensitive element 5, a developing unit 7 that supplies toner on the surface of the photosensitive element 5, a cleaning device 8 that cleans the surface of the photosensitive element 5. In FIG. 1, the reference numerals are provided only to the photosensitive element 5, the charging device 6, the developing unit 7, and the cleaning device 8 included in the image forming unit 4K for black, and the reference numerals for the other image forming units 4Y, 4M, and 4C are omitted.

Below the respective image forming units 4Y, 4M, 4C, and 4K, arranged is an exposing device 9 that exposes the surfaces of the photosensitive elements 5. The exposing device 9 includes a light source, a polygon mirror, an f-O lens, a reflecting mirror, and irradiates the surface of each of the photosensitive elements 5 with laser light based on image data.

Above the respective image forming units 4Y, 4M, 4C, and 4K, a transfer device 3 is arranged. The transfer device 3 includes an intermediate transfer belt 30 as a transfer body, four primary transfer rollers 31 as a primary transfer unit, a secondary transfer roller 36 as a secondary transfer unit, a secondary transfer backup roller 32, a cleaning backup roller 33, a tension roller 34, and a belt cleaning device 35.

The intermediate transfer belt 30 is an endless belt, and is stretched around the secondary transfer backup roller 32, the cleaning backup roller 33, and the tension roller 34. The secondary transfer backup roller 32 here rotates to drive, thereby making the intermediate transfer belt 30 go around (rotate) in a direction indicated by an arrow in FIG. 1.

Each of the four primary transfer rollers 31 nips the intermediate transfer belt 30 with corresponding one of the photosensitive elements 5 to form a primary transfer nip. Furthermore, each of the primary transfer rollers 31 is connected with a power supply not depicted, and a given direct-current voltage (DC) and/or alternating-current voltage (AC) is applied to each of the primary transfer rollers 31.

The secondary transfer roller 36 nips the intermediate transfer belt 30 with the secondary transfer backup roller 32 to form a secondary transfer nip. Furthermore, similarly to the primary transfer rollers 31, the secondary transfer roller 36 is also connected with a power supply not depicted, and a given direct-current voltage (DC) and/or alternating-current voltage (AC) is applied to the secondary transfer roller 36.

The belt cleaning device 35 has a cleaning brush and a cleaning blade arranged to abut the intermediate transfer belt 30. Extending from the belt cleaning device 35 is a waste toner transfer hose, not depicted, connected to an inlet portion of a waste toner storage not depicted.

At the upper portion of the printer main body, a bottle housing unit 2 is provided, and in the bottle housing unit 2, four pieces of toner bottles 2Y, 2M, 2C, and 2K that house replenishing toner are detachably attached. Between each of the toner bottles 2Y, 2M, 2C, and 2K and corresponding one of the developing units 7, a replenishing path not depicted is provided, and each of the developing units 7 is replenished with the toner from corresponding one of the toner bottles 2Y, 2M, 2C, and 2K via the corresponding replenishing path.

Meanwhile, at the bottom portion of the printer main body, provided are a paper feed tray 10 that houses a sheet P as a recording medium, a paper feeding roller 11 that delivers the sheet P from the paper feed tray 10, and others. The recording medium includes heavy paper, a post card, an envelope, thin paper, coated paper (coat paper, art paper, and such), tracing paper, and an OHP transparency as well as plain paper. Although not depicted, a manual feed mechanism may be provided.

Inside the printer main body, arranged is a conveying path R to cause the sheet P to pass from the paper feed tray 10 through the secondary transfer nip and discharge the sheet P to the outside of the apparatus. In the conveying path R, upstream of the position of the secondary transfer roller 36 in a sheet conveying direction, arranged is a pair of registration rollers 12 as a conveying unit that conveys the sheet P to the secondary transfer nip.

Downstream of the secondary transfer roller 36 in the sheet conveying direction, arranged is a fixing device 20 to fix an unfixed image transferred onto the sheet P. Furthermore, downstream of the fixing device 20 in the sheet conveying direction, provided is a pair of discharge rollers 13 to discharge the sheet to the outside of the apparatus. At the top surface portion of the printer main body, provided is a discharge tray 14 to stock the sheet discharged to the outside of the apparatus.

The basic operation of the image forming apparatus configured as above is as follows.

When image forming operation is started, the photosensitive element 5 in each of the respective image forming units 4Y, 4M, 4C, and 4K is driven to rotate in a clockwise direction in FIG. 1 by a drive unit not depicted, and the surface of each of the photosensitive elements 5 is uniformly charged in a given polarity by the charging device 6. The charged surface of each of the photosensitive elements 5 is irradiated with the laser light from the exposing device 9, and an electrostatic latent image is formed on the surface of each of the photosensitive elements 5. At this time, image information exposed to each of the photosensitive elements 5 is image information of a single color that is obtained by separating a desired full color image into color information of yellow, magenta, cyan, and black. On the electrostatic latent image formed on each of the photosensitive elements 5 in this manner, toner is supplied by each of the developing units 7, whereby the electrostatic latent image is actualized (visualized) as a toner image.

Furthermore, when the image forming operation is started, the secondary transfer backup roller 32 is driven to rotate in a counter-clockwise direction in FIG. 1, and makes the intermediate transfer belt 30 go around in the direction indicated by the arrow in FIG. 1. On each of the primary transfer rollers 31, a voltage under constant voltage or constant current control in a polarity opposite to the charged polarity of the toner is then applied. Thereby, at the primary transfer nip formed between each of the primary transfer rollers 31 and corresponding one of the photosensitive elements 5, a transfer electric field is formed.

Thereafter, when the toner image of each color on corresponding one of the photosensitive elements 5 reaches the primary transfer nip by the rotation of the photosensitive element 5, it is transferred onto the intermediate transfer belt 30 by the transfer electric field formed at the primary transfer nip so that the toner images on the respective photosensitive elements 5 are sequentially overlaid. In this way, a full color toner image is carried on the surface of the intermediate transfer belt 30. The toner on each of the photosensitive elements 5 that fails to be transferred to the intermediate transfer belt 30 is removed by the cleaning device 8. Subsequently, the surface of each of the photosensitive elements 5 is neutralized by a neutralization device not depicted, and thus the surface potential is initialized.

At the bottom portion of the image forming apparatus, the paper feeding roller 11 starts being driven to rotate, and the sheet P is sent out from the paper feed tray 10 to the conveying path R. The sheet P sent out to the conveying path R is sent to the secondary transfer nip formed between the secondary transfer roller 36 and the secondary transfer backup roller 32 with timing adjusted by the registration rollers 12. At this time, a transfer voltage in a polarity opposite to the charged polarity of the toner of the toner image on the intermediate transfer belt 30 is applied to the secondary transfer roller 36, whereby a transfer electric field is formed at the secondary transfer nip.

When the toner image on the intermediate transfer belt 30 then reaches the secondary transfer nip by the go-around of the intermediate transfer belt 30, the toner image on the intermediate transfer belt 30 is collectively transferred onto the sheet P by the transfer electric field formed at the secondary transfer nip. The residual toner on the intermediate transfer belt 30 that fails to be transferred onto the sheet P is removed by the belt cleaning device 35, and the removed toner is conveyed to the waste toner storage not depicted to be collected.

Thereafter, the sheet P is conveyed to the fixing device 20, and the toner image on the sheet P is fixed to the sheet P by the fixing device 20. The sheet P is then discharged to the outside of the apparatus by the discharge rollers 13 and stocked on the discharge tray 14.

While the above-described explanation is for the image forming operation when a full color image is formed on a sheet, an image of a single color can be formed using any one of the four image forming units 4Y, 4M, 4C, and 4K, or a two- or three-colored image can be formed using two or three image forming units.

Next, with reference to FIG. 2, the configuration of the fixing device 20 will be described.

Figure 2:
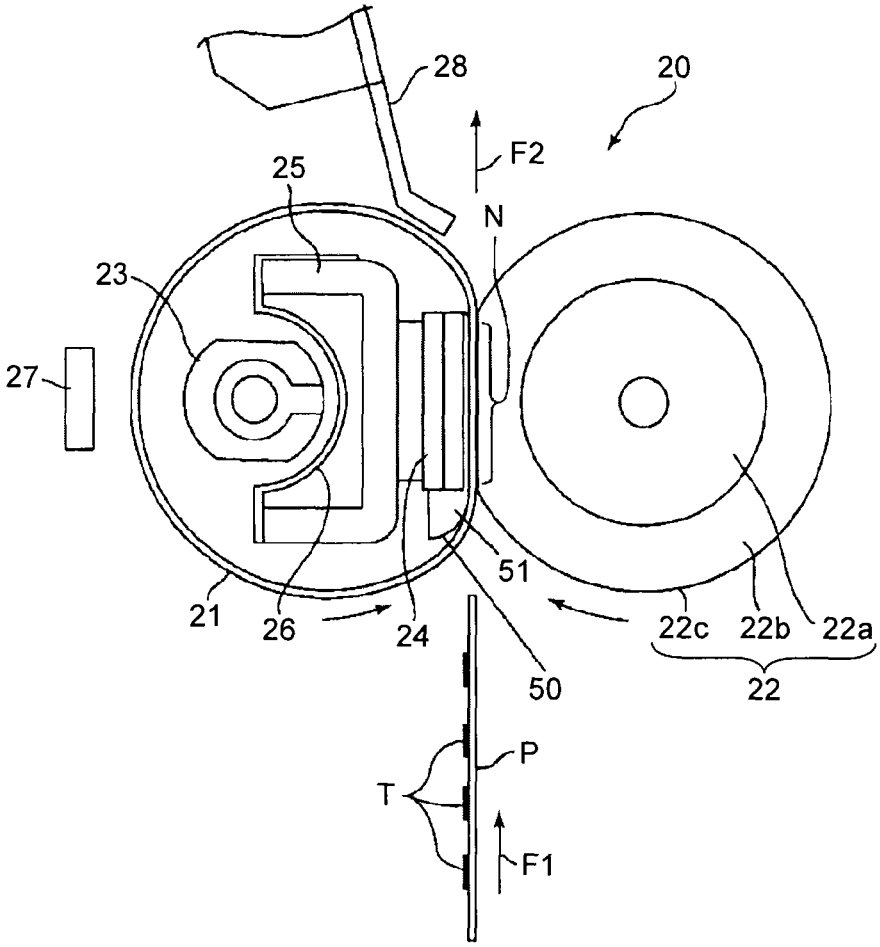
FIG. 2 is a view for schematically explaining a configuration of a fixing device mounted on the image forming apparatus.

As illustrated in FIG. 2, the fixing device 20 includes a fixing belt 21 used as a rotatable fixing rotating body, a pressing roller 22 used as a facing rotating body that can rotate while facing the fixing belt 21, a halogen heater 23 used as a heat source that heats up the fixing belt 21, a nip forming member 24 arranged inside the fixing belt 21, a stay 25 used as a supporting member that supports the nip forming member 24, a reflecting member 26 that reflects light emitted from the halogen heater 23, to the fixing belt 21, a temperature sensor 27 used as a temperature detecting unit that detects the temperature of the fixing belt 21, a separating member 28 that separates a sheet from the fixing belt 21, a pressing unit (not depicted) used to press the pressing roller 22 to the fixing belt 21.

As the fixing belt 21, a thin endless belt member having flexibility (including film) is used.

The fixing belt 21 includes a base material formed of metallic material such as nickel and stainless steel (SUS) or resin material such as polyimide (PI) at the inner circumferential side, and a release layer formed of tetrafluoroethylene-perfluoroalkylvinylether copolymer (PFA), polytetrafluoroethylene (PTFE), or the like at the outer circumferential side. Furthermore, an elastic layer formed of rubber material such as silicone rubber, expandable silicone rubber, and fluoro-rubber may lie between the base material and the release layer.

The pressing roller 22 includes a core metal 22*a*, an elastic layer 22*b* for which expandable silicone rubber, silicone rubber, or fluoro-rubber arranged on the surface of the core metal 22*a* is used, and a release layer 22*c* for which PFA or PTFE provided on the surface of the elastic layer 22*b* is used. The pressing roller 22 is pressed by the pressing unit not depicted towards the fixing belt 21 to abut the nip forming member 24 via the fixing belt 21.

At the location at which the pressing roller 22 and the fixing belt 21 are pressed against each other, the elastic layer 22*b* of the pressing roller 22 is squashed to form a nip portion N having a given width.

The pressing roller 22 is driven to rotate by a drive source such as a motor (not depicted) provided in the printer main body. When the pressing roller 22 is driven to rotate, the driving force thereof is transmitted to the fixing belt 21 at the nip portion N, and the fixing belt 21 is caused to rotate.

While the pressing roller 22 is a solid roller in the present embodiment, the pressing roller 22 may be a hollow roller. In that case, a heat source such as a halogen heater may be arranged inside the pressing roller 22. Furthermore, when the elastic layer is not present, heat capacity becomes small, thereby improving fixing performance. However, when squashing unfixed toner to fix, minute irregularities of the belt surface may be transferred to an image causing uneven gloss in a solid portion of the image. To prevent this, it is preferable to provide the elastic layer in a thickness of 100 micrometers or thicker.

By providing the elastic layer in a thickness of 100 micrometers or thicker, the minute irregularities can be absorbed by elastic deformation of the elastic layer, whereby the occurrence of uneven gloss can be prevented. For the elastic layer 22*b*, solid rubber can be used, but sponge rubber may be used when a heat source is not provided inside the pressing roller 22. The sponge rubber is more preferable because the heat insulating properties become higher and the heat of the fixing belt 21 becomes harder to be drawn. The fixing rotating body and the facing rotating body are not restricted to the configuration of being pressed against each other, and they can be configured to simply contact with each other without applying any pressure.

Both ends of each halogen heater 23 are fixed to side plates (not depicted) of the fixing device 20. Each halogen heater 23 produces heat the output of which is controlled by a power supply unit arranged in the printer main body. The output control is performed based on the detection result of the surface temperature of the fixing belt 21 by the temperature sensor 27. By such output control of the heater 23, the temperature of the fixing belt 21 (fixing temperature) can be maintained at a desired temperature. As a heat source to heat up the fixing belt 21, other than a halogen heater, electromagnetic induction (1H), a resistance heating element, a carbon heater or the like may be used.

Figure 3:
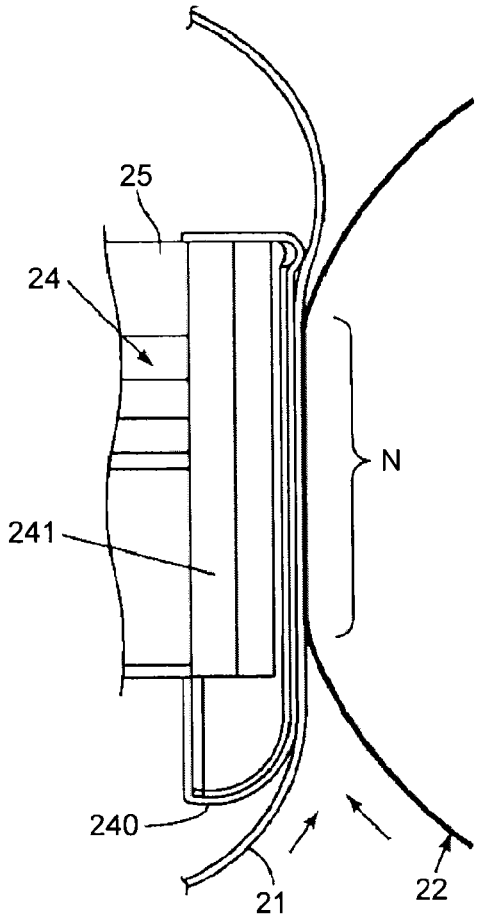
FIG. 3 is a view for explaining a configuration of a nip forming member used in the fixing device illustrated in FIG. 2.

FIG. 3 illustrates the configuration of the nip forming member 24.

The nip forming member 24 includes a base pad 241, and a slide sheet (low friction sheet) 240 winding around the base pad 241.

The base pad 241 is a member that receives the applied pressure of the pressing roller 22 and determines the shape of the nip portion N. Therefore, the base pad 241 is arranged in parallel with the axis direction of the fixing belt 21 or the axis direction of the pressing roller 22, and is fixedly supported by the stay 25 used as a supporting member of the nip forming member 24. For the base pad 241, as discussed below, for example, resin material such as liquid crystal polymer (LCP), metallic material, or ceramic material is used.

Accordingly, the deflection of the nip forming member 24 by the pressure of the pressing roller 22 is prevented from occurring, whereby the nip having a uniform width in the direction parallel with the axis direction of the pressing roller 22 can be obtained. It is preferable that the stay 25 be formed of metallic material having high mechanical strength such as stainless steel (SUS) and iron to satisfy the function of preventing the deflection of the nip forming member 24, but the stay 25 can be made of resin.

The base pad 241 is composed of a heat-resistant member having a heat-resistant temperature of 200 degrees C. or higher. Accordingly, the deformation of the base pad 241 at a toner fixing temperature region can be prevented, whereby a stable condition of the nip portion N can be ensured. As a consequence, stabilized output image quality can be achieved.

For the base pad 241, common heat-resistant resin such as polyethersulfone (PES), polyphenylene sulfide (PPS), liquid crystal polymer (LCP), polyethernitrile (PEN), polyamide-imide (PAI), and polyether ketone (PEEK) can be used.

On at least a portion of the surface of the base pad 241 facing the fixing belt 21, the slide sheet (low friction sheet) 240 having a low friction coefficient is arranged.

When the fixing belt 21 rotates, the slide sheet (low friction sheet) 240 makes the surface of the fixing belt 21 slide. The slide sheet (low friction sheet) 240 is used to reduce drive torque that arises on the sliding fixing belt 21, and to reduce a load by friction force on the fixing belt 21. For the material of the slide sheet (low friction sheet) 240, for example, PTFE is used.

The base pad 241 has a function of determining the shape of the nip portion N constructed with the pressing roller 22 that faces the base pad 241 with the slide sheet (low friction sheet) 240 there between. Therefore, the surface facing the nip portion N is nearly flat, in other words, has a straight shape. As a material to maintain this shape, a material having certain hardness is used. Specifically, a molded component of crystalline thermoplastics used as liquid crystal polymer or the like, for example, aramid fiber is used. In place of resin, material capable of retaining shape such as metal and ceramics may be used.

The reflecting member 26 is made of aluminum, stainless steel (SUS), or the like the surface of which can be used as a reflective surface, and is arranged between the stay 25 and the halogen heater 23. In the present embodiment, the reflecting member 26 is secured to the stay 25. Because the reflecting member 26 is directly heated by the halogen heater 23, it is preferable to be formed of metallic material or the like having a high melting point. By the reflecting member 26 arranged this way, the light emitted from the halogen heater 23 towards the stay 25 side is reflected to the fixing belt 21. Consequently, the amount of light irradiating the fixing belt 21 can be increased, whereby the fixing belt 21 can be heated up efficiently. Furthermore, because the radiation heat from the halogen heater 23 can be prevented from being transmitted to the stay 25 and others, energy saving can also be achieved.

Furthermore, without providing the reflecting member 26 as in the present embodiment, a reflective surface may be formed by performing a mirror-like finish such as polishing or coating on the surface of the stay 25 facing the halogen heater 23. In addition, it is preferable that the reflectivity of the reflecting member 26 or the reflective surface of the stay 25 be 90 percent or higher.

However, the shape and material of the stay 25 are not freely selectable because its strength should be ensured. Therefore, separately providing the reflecting member 26 as in the present embodiment increases the degree of freedom in selecting the shape and material thereof, and the reflecting member 26 and the stay 25 can be specialized for their respective functions. The reflecting member 26 being provided between the halogen heater 23 and the stay 25 makes the reflecting member 26 close to the halogen heater 23, whereby the fixing belt 21 can be efficiently heated up.

To further improve the heating efficiency of the fixing belt 21 by the reflection of light, the orientation of the reflecting member 26 or the reflective surface of the stay 25 needs to be considered.

Figure 4A:
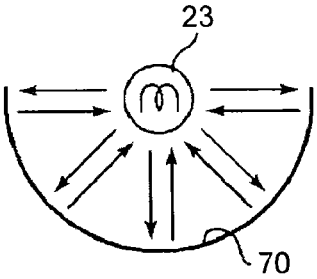
FIGS. 4A and 4B are views for explaining configurations of a reflective surface.

For example, as illustrated in FIG. 4A, when a reflective surface 70 is arranged to lie on a circle having its center on the halogen heater 23, the light is reflected towards the halogen heater 23 and the heating efficiency is lowered to that extent.

Figure 4B:
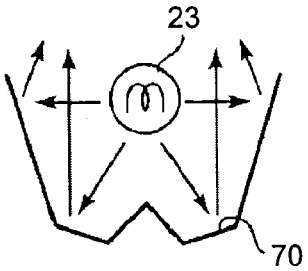

In contrast, as illustrated in FIG. 4B, when a part or the whole of the reflective surface 70 is directed to reflect the light in a direction towards the fixing belt and other than a direction towards the halogen heater 23, the amount of light reflected in the direction towards the halogen heater 23 is reduced, and thus the heating efficiency by the reflected light can be improved.

In the fixing device 20 in the present embodiment, a variety of innovations in the configuration are introduced to improve in energy saving, first print time, and others.

Specifically, it is configured such that the halogen heater 23 can directly heat up the fixing belt 21 at the portion other than the nip portion N (direct heating method).

In the present embodiment, nothing is arranged between the left side portion of the fixing belt 21 in FIG. 2 and the portion of the halogen heater 23 facing that portion. Accordingly, at the position where the halogen heater 23 and the fixing belt 21 face each other, the radiation heat from the halogen heater 23 is directly applied to the fixing belt 21.

To lower the heat capacity of the fixing belt 21, the fixing belt 21 is made to be thin and in a small diameter.

Specifically, the thicknesses of the base material, the elastic layer, and the release layer constituting the fixing belt 21 are configured to be in the range of 20 to 50 micrometers, the range of 100 to 300 micrometers, and the range of 5 to 50 micrometers, respectively, and the thickness of the fixing belt 21 as a whole is configured to be one millimeter or less. The diameter of the fixing belt 21 is configured to be 20 to 40 millimeters. To further lower the heat capacity, the thickness of the whole fixing belt 21 is preferable to be 0.2 millimeter or less, and is more preferable to be 0.16 millimeter or less. The diameter of the fixing belt 21 is preferable to be 30 millimeters or less.

In the present embodiment, the diameter of the pressing roller 22 is configured to be 20 to 40 millimeters, and the diameter of the fixing belt 21 and that of the pressing roller 22 are made to be equal. However, it is not restricted to this configuration. For example, the fixing belt 21 may be formed to have a diameter smaller than that of the pressing roller 22. In that case, because the curvature of the fixing belt 21 at the nip portion N is smaller than that of the pressing roller 22, a recording medium ejected from the nip portion N becomes easily separated from the fixing belt 21.

Figure 5A:
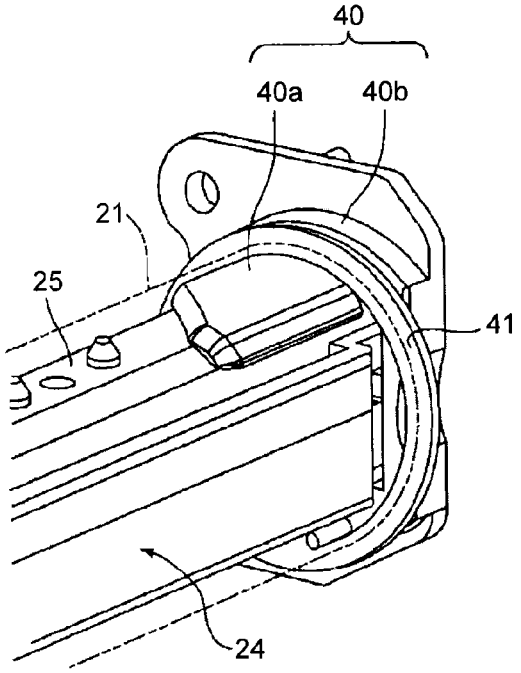
FIGS. 5A to 5C are views illustrating a configuration of an end of a fixing belt, FIG. 5A being a perspective view, FIG. 5B being a plan view, and FIG. 5C being a side view taken from a direction of a rotation axis of the fixing belt.
Figure 5B:
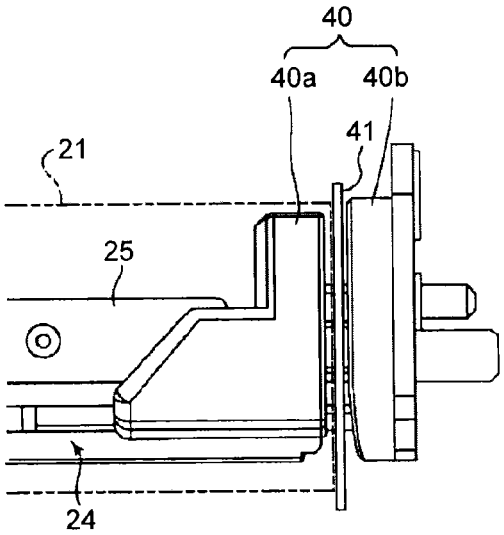
Figure 5C:
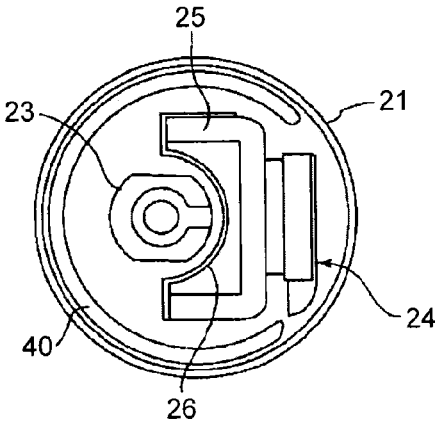

FIGS. 5A to 5C are views illustrating the configuration of the end of the fixing belt in the width direction (axis direction). FIG. 5A is a perspective view, FIG. 5B is a plan view, and FIG. 5C is a side view taken in the direction of rotation axis of the fixing belt. While the configuration of the only one end is illustrated in FIGS. 5A to 5C, the opposite end is similarly configured. Accordingly, only the configuration of the one end will be described hereinafter with reference to FIGS. 5A to 5C.

As illustrated in FIG. 5A or 5B, at the end of the fixing belt 21 in the width direction, a belt retaining member 40 is inserted. The end of the fixing belt 21 in the width direction is rotatably held by the belt retaining member 40. The belt retaining member 40 is composed of a belt-shift stopping guide portion 40*a*, and a belt-rotation guide portion 40*b*. The belt-shift stopping guide portion 40*a* serves as a guide to stop shift of the fixing belt 21 in the axis direction (a thrust direction), and the belt-rotation guide portion 40*b* serves as a guide in the rotational direction of the belt. As illustrated in FIG. 5C, the belt retaining member 40 is formed in a C-shape open at the position of the nip portion (the position at which the nip forming member 24 is arranged). The end of the stay 25 is secured to the belt retaining member 40 so as to be positioned.

As illustrated in FIG. 5A or 5B, between the end face of the fixing belt 21 and the facing surface of the belt-shift stopping guide portion 40*a* that faces the end face, provided is a slip ring 41 as a protective member that protects the end of the fixing belt 21 in the width direction. Because the belt-shift stopping guide portion 40*a* is non-rotational, wear of the belt-shift stopping guide portion 40*a* is caused by the contact and rotation of the end of the fixing belt 21. Therefore, providing the slip ring 41 that can be rotated by the rotation of the fixing belt 21, between the fixing belt 21 and the belt-shift stopping guide portion 40*a* allows reducing the wear of the belt-shift stopping guide portion 40*a*.

Consequently, when the shift of the fixing belt 21 in the width direction (axis direction) occurs, the end of the fixing belt 21 can be prevented from directly abutting the belt-shift stopping guide portion 40*a*, whereby the wear and damage of the end can be prevented.

Furthermore, the slip ring 41 is fitted on the outer circumference of the belt retaining member 40 with some margin. Accordingly, the slip ring 41 can rotate in conjunction with the fixing belt 21 when the end of the fixing belt 21 contacts the slip ring 41. However, the slip ring 41 need not rotate in conjunction but may remain still. As the material for the slip ring 41, it is preferable to apply a so-called super engineering plastic having excellent heat resistance, for example, PEEK, PPS, PAI, and PTFE.

Although the illustration is omitted, at both ends of the fixing belt 21 in the axis direction, blocking members that block the heat from the halogen heater 23 are arranged between the fixing belt 21 and the halogen heater 23. This makes it possible to prevent an excessive rise in temperature at the non-sheet passing area of the fixing belt when passing the sheets continuously, whereby the deterioration and damage of the fixing belt by heat can be prevented. In the present embodiment, the members that contact the inner circumferential surface of the fixing belt 21 are the belt retaining members 40 at both ends and the nip forming member 24 only, and, other than these members, there are no belt guides which contact the inner circumferential surface of the fixing belt 21 to guide the rotation.

With reference to FIG. 2, the basic operation of the fixing device in the present embodiment will be described hereinafter.

When a power switch of the printer main body is turned on, the halogen heater 23 is supplied with power and the pressing roller 22 starts being driven to rotate in a clockwise direction in FIG. 2. Accordingly, the fixing belt 21 is rotated in a counter-clockwise direction in FIG. 2 by the frictional force exerted by the pressing roller 22.

Thereafter, the sheet P made to carry an unfixed toner image T by the above-described image forming processes is conveyed in a direction of an arrow F1 in FIG. 2 while being guided by guiding plates not depicted and fed into the nip portion N between the fixing belt 21 and the pressing roller 22 in a state of being pressed against each other. Then, by the heat of the fixing belt 21 that is heated up by the halogen heater 23 and by the pressure between the fixing belt 21 and the pressing roller 22, the toner image T is fixed onto the surface of the sheet P.

The sheet P on which the toner image T is fixed is delivered in a direction of an arrow F2 in FIG. 2 from the nip portion N. At this time, the leading end of the sheet P contacting the tip of the separating member 28 separates the sheet P from the fixing belt 21. Thereafter, as in the foregoing, the separated sheet P is discharged by the discharge rollers 13 (see FIG. 1) to the outside of the apparatus, and is stocked in the discharge tray 14 (see FIG. 1).

Now, the configuration of the stay will be described further in detail.

Figure 6:
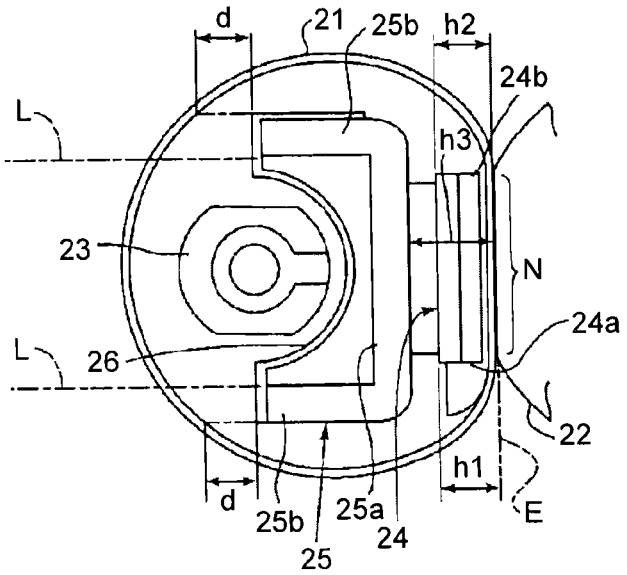
FIG. 6 is a view for explaining a configuration of a stay used in the fixing device illustrated in FIG. 2.

As illustrated in FIG. 6, the stay 25 includes a base portion 25*a* contacting the nip forming member 24 and extending in a sheet conveying direction (up-and-down direction in FIG. 6), and rising portions 25*b* extending in the abutting direction of the pressing roller 22 (left side in FIG. 6) from the respective ends of the base portion 25*a* on the upstream side and on the downstream side in the sheet conveying direction. The tip of each rising portion 25*b* is arranged to be close to the inner circumferential surface of the fixing belt 21 in the abutting direction of the pressing roller 22.

A distance d between the tip of the rising portion 25*b* and the inner circumferential surface of the fixing belt 21, more specifically, the distance d between the tip of the rising portion 25*b* and the inner surface of the fixing belt 21 along the abutting direction of the pressing roller 22, is set based on the following conditions.

For example, when the fixing belt 21 has stiffness and has not much flutter (does not flap) while moving, the distance d is set to about 0.02 millimeter at which the stay 25 and the fixing belt 21 do not make contact with each other. The size of 0.02 millimeter set as the distance d is a value determined considering the processing accuracy of the fixing belt 21.

Meanwhile, when the fixing belt 21 is thin like a film and not sufficiently rigid, the distance d is set to 3.0 millimeters or less to avoid the fixing belt 21 to contact the stay 25 considering that the flapping of the fixing belt 21 while moving becomes harder.

When the reflecting member 26 is attached to the tip of the rising portion 25*b* as in the present embodiment, the distance d needs to be set such that the reflecting member 26 makes no contact with the fixing belt 21.

As in the foregoing, arranging the tip of the rising portion 25*b* to be close to the inner circumferential surface of the fixing belt 21 allows extending the rising portion 25*b* longer in the abutting direction of the pressing roller 22. More specifically, because the rising portion 25*b* has a laterally elongated cross-section extending in the pressing direction of the pressing roller 22, the section modulus thereof becomes high, thereby preventing the deflection of the stay 25 in the elongated direction in which the pressure is applied from the pressing roller 22, whereby the mechanical strength of the stay 25 can be improved.

The section modulus is a modulus calculated from the shape of a cross-section as a basis to calculate the magnitude of bending stress generated in a structural material. When a lateral load acts on the stay 25, the stay 25 undergoes a bending deformation. The stress caused to the stay 25 by the bending action becomes tension on the projecting side of a neutral plane where no tension or no compression is received, and becomes compression on the depressed side thereof. The bending stress of the stay 25 at a certain cross-section is proportional to the distance from a neutral axis (a line of intersection between the neutral plane and the cross-section and a straight line that runs through a centroid of the cross-section), and becomes maximum at the farthest point from the neutral axis. The section modulus is obtained by dividing the second moment of area by the distance from the neutral axis to this point, and is a constant determined by the shape of the cross-section and the position of the neutral axis. By using a cross-sectional shape having a high section modulus, a maximum bending stress generated in the stay 25 can be made small even if the cross-sectional area is not changed.

The second moment of area here is a quantity representing difficulty of deformation of an object against a bending moment, and is represented by I similarly to the moment of inertia. Because the value of the second moment of area changes when the cross-section of the object is changed, the second moment of area is used as an index in design to improve the durability of a structure. The second moment of area is expressed in units of $cm^4$.

The contact pressure necessary not to cause any slipping or the like in rotary drive at the nip portion N is 0.6 $kgf/cm^2$ or higher. When the section modulus of the stay 25 is made to be 200 $mm^3$ or higher, the bending deformation of the stay 25 when the pressing roller 22 is driven to rotate and the driving force thereof is transmitted to the fixing belt 21 at the nip portion N is prevented. Additionally, by a cross-sectional shape of a high section modulus being selected without changing the cross-sectional area, the respective members can be laid out efficiently within the diameter of the fixing belt 21 of a small diameter.

In the present embodiment, to arrange the stay 25 to be as large as possible within the fixing belt 21, the nip forming member 24 is formed compactly.

Specifically, the width of the nip forming member 24 in the sheet conveying direction is formed smaller than the width of the stay 25 in the sheet conveying direction.

In FIG. 6, when the heights of an upstream side end 24*a* and a downstream side end 24*b* of the nip forming member 24 in the sheet conveying direction, relative to the nip portion N or its virtual extension line E are defined as h1 and h2, respectively, and a maximum height of a portion of the nip forming member 24 other than the upstream side end 24*a* and the downstream side end 24*b* in the sheet conveying direction, relative to the nip portion N or its virtual extension line E is defined as h3, the configuration is made so that h1≤h3 and h21≤h3 are satisfied.

By having such a relationship, the upstream side end 24*a* and the downstream side end 24*b* of the nip forming member 24 in the sheet conveying direction do not stand between each of bending portions of the stay 25 on the upstream side and on the downstream side in the sheet conveying direction and the fixing belt 21, whereby each of the bending portions can be arranged close to the inner circumferential surface of the fixing belt 21. Consequently, the stay 25 can be arranged as large as possible within a limited space inside the fixing belt 21, whereby the strength of the stay 25 can be ensured.

Furthermore, in the present embodiment, the fixing belt 21 is guided only by the nip forming member 24 at a part other than the ends thereof (at the ends, the fixing belt 21 is also guided by the belt retaining members 40). More specifically, because no guide members other than the nip forming member 24 are provided between the fixing belt 21 and the stay 25, the stay 25 can be arranged closer to the fixing belt 21, and thus the improvement in strength of the stay 25 can be achieved.

In the present embodiment, the halogen heater 23 is arranged inside both rising portions 25*b* or inside extension lines L of the inner surfaces of both rising portions 25*b*. The halogen heater 23 being arranged this way allows compactly housing the halogen heater 23 and the stay 25 within the fixing belt 21.

As in the present embodiment, because a part (or the whole) of the halogen heater 23 is housed inside the stay 25, the irradiated area of the fixing belt 21 with the light from the halogen heater 23 is narrowed down to a given area.

Generally, in the circumferential direction of the fixing belt 21, the heating temperature at a portion close to the halogen heater 23 becomes high, while that at a portion away from the halogen heater 23 becomes low. Therefore, as in the present embodiment, by housing the halogen heater 23 inside the stay 25 and narrowing down the irradiated area of the fixing belt 21 with the light to the area where the relatively small difference in distance is caused, fluctuation in heating temperature can be suppressed, whereby the image quality can be improved.

Figure 7A:
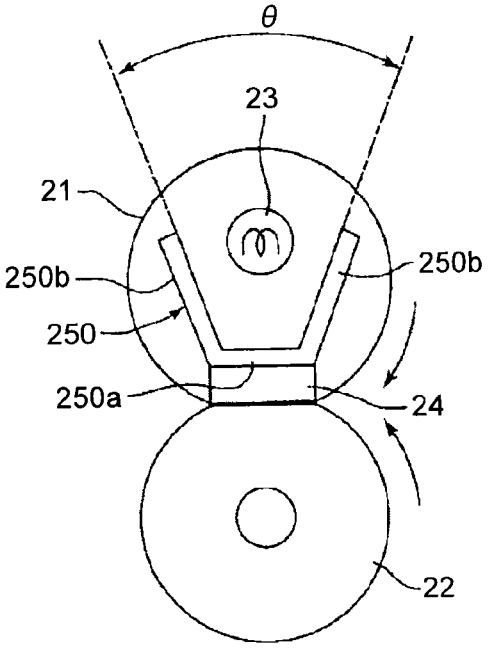
FIGS. 7A and 7B are views illustrating modifications of the stay.
Figure 7B:
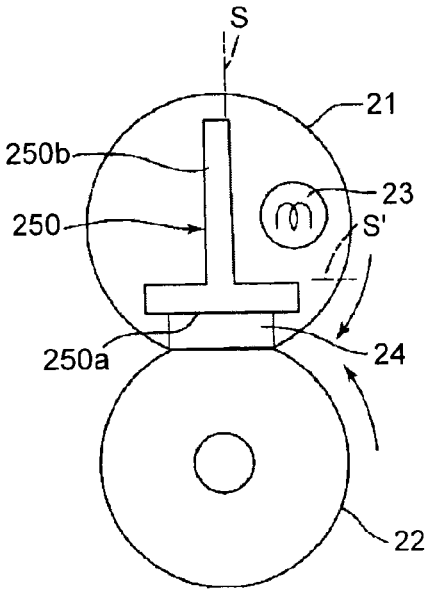

With reference to FIGS. 7A and 7B, modifications of the stay will be described.

The stay 25 illustrated in FIGS. 2 and 6 is arranged such that both rising portions 25*b* to be nearly orthogonal to the base portion 25*a*. However, in FIG. 7A, in a stay indicated by the reference numeral 250, both rising portions 250*b* are inclined (an opened state indicated by a symbol θ) with respect to a base portion 250*a*. Furthermore, as illustrated in FIG. 7B, there may be a single rising portion 250*b*.

In these modifications, by making the tip of the rising portion 250*b* close to the inner circumferential surface of the fixing belt 21 in the abutting direction of the pressing roller 22, and by making the section modulus of the stay 250 be 200 $mm^3$ or higher, the strength of the stay 25 can be ensured.

As long as the section modulus is 200 $mm^3$ or higher, the stay 250 can be formed in a shape other than these.

The halogen heater 23 illustrated in FIG. 7B being arranged between an extension line S of the inner surface of the rising portion 250*b* on the downstream side in the rotational direction of the fixing belt and an extension line S' of the inner surface of the base portion 250*a* of the stay 250 on the upstream side in the rotational direction of the fixing belt allows the heat discharge of the fixing belt 21 after being heated until reaching the nip portion N to be a minimum, whereby energy saving can be further improved.

Next, with reference to FIG. 8, another embodiment of a fixing device to which the present invention is applied will be described.

Figure 8:
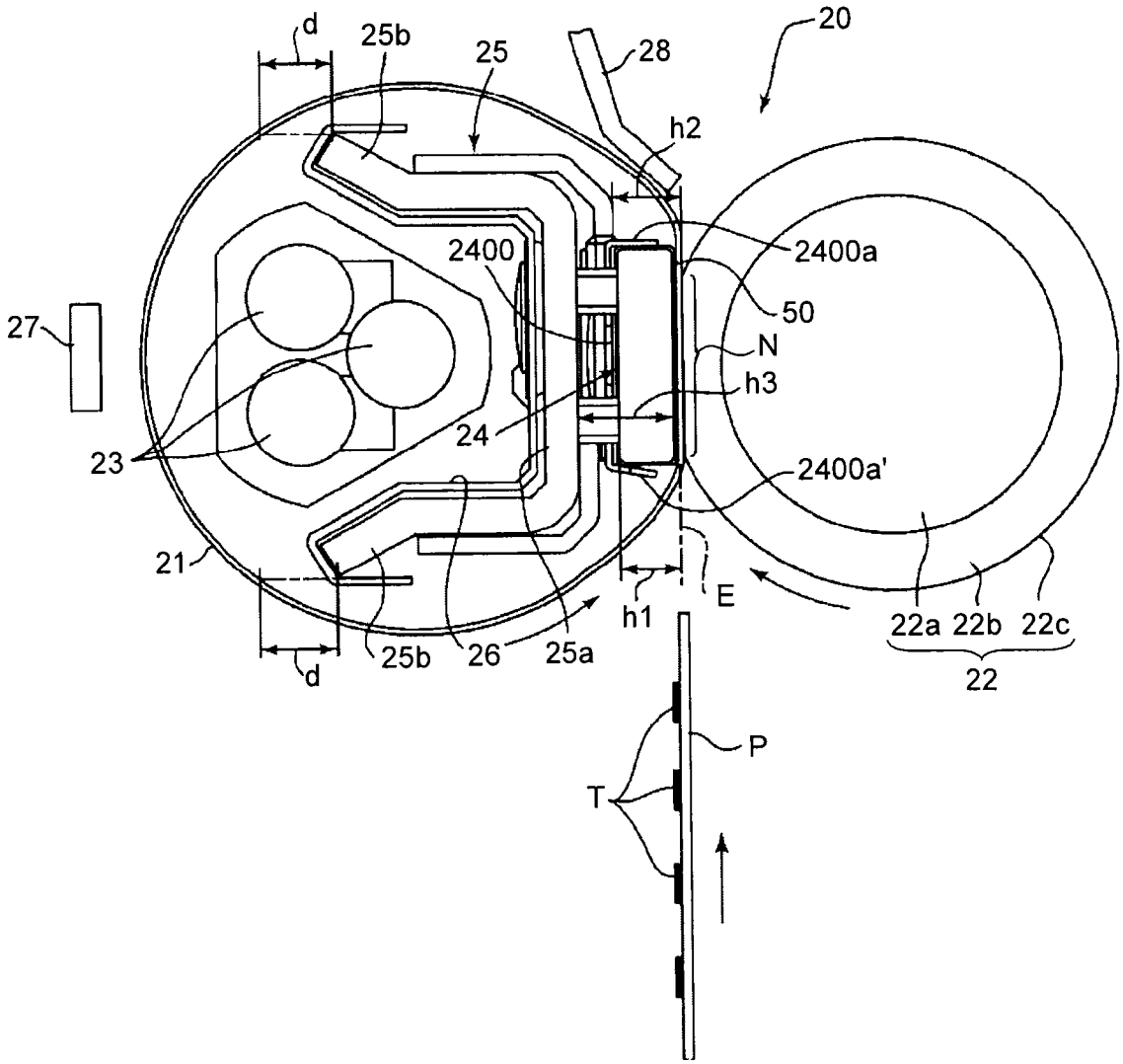
FIG. 8 is a view for schematically explaining a configuration of a fixing device according to another embodiment.
Figure 9:
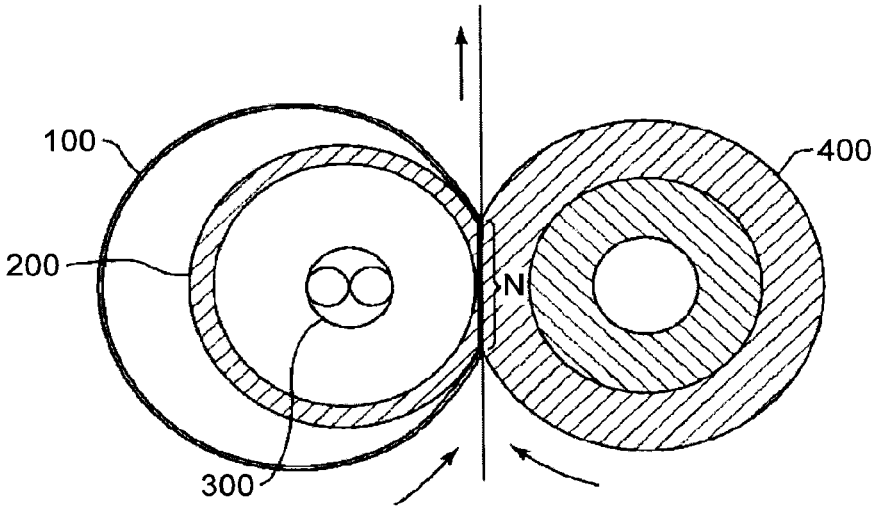
FIG.9 RELATED ART
FIG. 9 is a schematic view illustrating a configuration of a conventional fixing device.
Figure 10:
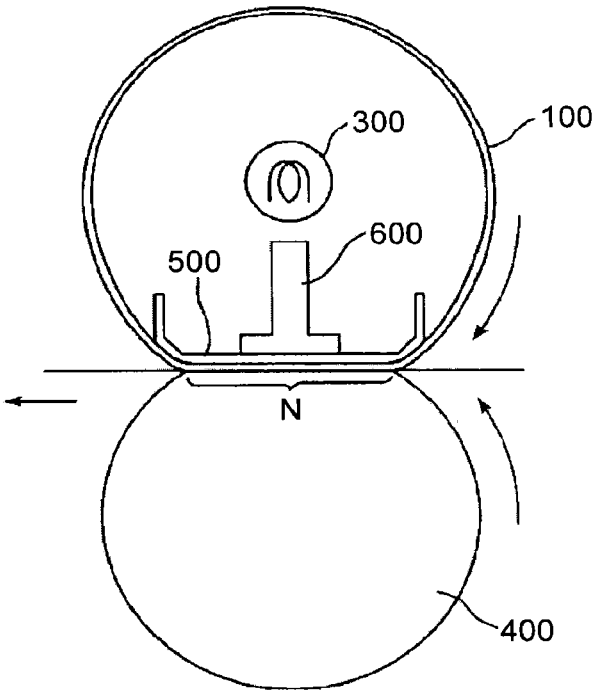
FIG.10 RELATED ART
FIG. 10 is a schematic view illustrating a configuration of another conventional fixing device.

The fixing device 20 illustrated in FIG. 8 includes the three halogen heaters 23 as a heat source. In this case, by differentiating a heating area for each halogen heater 23, the fixing belt 21 can be heated at the areas corresponding to various sheet widths. The configuration other than the foregoing is basically the same as that of the embodiment illustrated in FIG. 2.

More specifically, in the present embodiment, as illustrated in FIG. 8, the stay 25 is set to have the section modulus of 200 $mm^3$ or higher, and the rising portions 25*b* are made to be close to the inner circumferential surface of the fixing belt 21 in the abutting direction of the pressing roller 22.

In FIG. 8, the symbols h1, h2, and h3 represent the respective heights of the nip forming member 24 similarly to those illustrated in FIG. 6, and in the present embodiment, the configuration is made so that h1≤h3 and h2≤h3 are satisfied so as to arrange the stay 25 as large as possible within the fixing belt 21.

In the configuration illustrated in FIG. 8, differently from the configuration illustrated in FIG. 2, the nip forming member 24 is retained by a retaining member 2400 made of a sheet-metal member having side portions 2400*a* and 2400*a*' that can hold the top and bottom surfaces of the nip forming member 24, respectively, and on the surface of the nip forming member 24 that faces the nip portion N, a low friction sheet 50 is provided as in the configuration illustrated in FIG. 2.

As in the foregoing, in accordance with the present invention, the mechanical strength of the stay 25 can be ensured by making the section modulus of the stay 25 be 200 $mm^3$ or higher, whereby the deflection of the nip forming member 24 by the pressing roller 22 can be prevented. Consequently, the nip width can be made uniform in the axis direction of the pressing roller 22, whereby a good image can be obtained.

Particularly, in the configuration in which the diameter of the fixing belt 21 is made small as in the above-described embodiments, the space to arrange the stay 25 or 250 also becomes small. However, applying the configuration of the invention allows selecting a cross-sectional shape of a high section modulus even without changing the cross-sectional area, whereby the respective members can be efficiently laid out within the diameter of the fixing belt 21 of a small diameter and the strength of the stay 25 or 250 can be ensured.

In each of the above-described embodiments of the invention, the configuration is made so that the nip forming member 24 is compactly formed and a separate guiding member is not provided between the fixing belt 21 and the stay 25, and thus the space necessary to arrange the stay 25 or 250 within the fixing belt 21 can be ensured to be large. Accordingly, in the above-described embodiments, the stay 25 or 250 can be formed to be compact and have a sufficient strength, whereby the deflection of the nip forming member 24 by the pressing roller 22 can be prevented more reliably.

While the embodiments of the present invention have been exemplified in the foregoing, the invention is not restricted to the above-described embodiments, and various modifications can of course be made without departing from the spirit of the invention. Furthermore, the fixing device according to the present invention can be mounted, not restricted to the color laser printer illustrated in FIG. 1, on monochrome image forming apparatuses, or other printers, copying machines, facsimiles, or MFPs of the foregoing apparatuses.

In accordance with the present invention, that the tip of the rising portion is made close to the inner circumferential surface of the fixing belt in the abutting direction of the facing rotating body and the section modulus of the supporting member is set to be a given value, for example, 200 $mm^3$ or higher, allows selecting a cross-sectional shape of a high section modulus even without changing the same cross-sectional area.

Consequently, using the member of an ensured strength within the diameter of the fixing belt of a small diameter allows laying out the respective members efficiently, and preventing the bending deformation of the supporting member allows preventing the nip forming member from deflecting by the abutment of the facing rotating body, whereby the nip width can be made uniform in the axis direction of the facing rotating body, and thus a good image can be obtained.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device comprising:

a rotatable endless fixing belt;

a nip forming member arranged inside the fixing belt;

a facing rotating body that abuts the nip forming member via the fixing belt to form a nip portion with the fixing belt;

a heat source that directly heats up the fixing belt at a portion other than the nip portion; and a support that supports the nip forming member, the support including a base at the nip portion and first and second rising portions that extend from the base portion in an abutting direction of the facing rotating body against the fixing belt, tips of the first and second rising portions at respective ends thereof being positioned a distance of 0.02 to 3 mm to an inner circumferential surface of the fixing belt, and the support having a section modulus of 200 $mm^3$ or higher, wherein the fixing device conveys a recording medium carrying an unfixed image to the nip portion between the rotating fixing belt and the facing rotating body to fix the unfixed image to the recording medium.

2. The fixing device according to claim 1, wherein the first and second rising portions are formed at opposing ends of the base of the support so as to be on an upstream side and on a downstream side in a recording medium conveying direction.

3. The fixing device according to claim 2, wherein the heat source is arranged between the respective ends of the first and second rising portions within extension lines of inner surfaces of the first and second rising portions.

4. The fixing device according to claim 1, wherein the heat source is arranged between an extension line of an inner surface of the first rising portion on a downstream side in a rotational direction of the fixing belt and an extension line of an inner surface of the second rising portion on an upstream side in the rotational direction of the fixing belt.

5. The fixing device according to claim 1, wherein the support is provided with a reflective surface that reflects light emitted from the heat source.

6. The fixing device according to claim 5, wherein reflectivity of the reflective surface is 90 percent or higher.

7. The fixing device according to claim 5, wherein at least a part of the reflective surface is directed to reflect the light in a direction towards the fixing belt and other than in a direction toward the heat source.

8. The fixing device according to claim 1, further comprising a reflector that extends across the support from the end of the first rising portion to the end of the second rising portion.

9. The fixing device according to claim 1, further comprising a reflector that extends across the supporting member on a side opposite the nip, the reflector having a concave portion therein that is accommodated between the first and second rising portions so as to reflect light from the heat source in a direction toward the fixing belt.

10. The fixing device according to claim 1, wherein the support comprises a U-shape.

11. An image forming apparatus comprising a fixing device that includes:

a rotatable endless fixing belt, a nip forming member arranged inside the fixing belt, a facing rotating body that abuts the nip forming member via the fixing belt to form a nip portion with the fixing belt, a heat source that directly heats up the fixing belt at a portion other than the nip portion, and a support that supports the nip forming member, the support including a base at the nip portion and first and second rising portions that extend from the base portion in an abutting direction of the facing rotating body against the fixing belt, tips of the first and second rising portions at respective ends thereof being positioned a distance of 0.02 to 3 mm to an inner circumferential surface of the fixing belt, and the support having a section modulus of 200 $mm^3$ or higher, wherein the fixing device conveys a recording medium carrying an unfixed image to the nip portion between the rotating fixing belt and the facing rotating body to fix the unfixed image to the recording medium.

12. The image forming apparatus according to claim 11, wherein the support comprises a U-shape.

13. A fixing device comprising:
a rotatable endless fixing belt;
a nip forming member arranged inside the fixing belt;
a rotating body that abuts the nip forming member via the fixing belt to form a nip portion with the fixing belt;
a heat source that directly heats up the fixing belt at a portion other than the nip portion;
a support that supports the nip forming member; and
a reflector disposed adjacent to the support, the reflector covering the support without surrounding an entirety of the support, the reflector having a concave face that opens in a pressing direction of the rotating body,
wherein the fixing device conveys a recording medium carrying an unfixed image to the nip portion between the rotating fixing belt and the rotating body to fix the unfixed image to the recording medium, and
wherein the support includes a rising portion extending in an abutting direction of the rotating body against the fixing belt and having a tip adjacent to an inner circumferential surface of the fixing belt, and is set to have a section modulus of 200 $mm^3$ or higher.

14. The fixing device according to claim 13, wherein the rising portion of the support has a laterally elongated cross-section extending in a pressing direction of the rotating body.

15. The fixing device according to claim 13, wherein a contact pressure at the nip portion between the rotating body and the fixing belt is at least 0.6 $kgf/cm^2$.

16. The fixing device according to claim 13, wherein:
the heat source is disposed upstream of a center of the nip portion in a sheet conveying direction.

17. A fixing device, comprising:
a rotatable endless fixing belt;
a nip forming member arranged inside the fixing belt;
a rotating body that abuts the nip forming member via the fixing belt to form a nip portion with the fixing belt;
a heat source that directly heats up the fixing belt at a portion other than the nip portion; and
a support that supports the nip forming member,
wherein the fixing device conveys a recording medium carrying an unfixed image to the nip portion between the rotating fixing belt and the rotating body to fix the unfixed image to the recording medium,
wherein the support includes a rising portion that rises directly from a base at the nip portion toward a pressing direction of the rotating body against the fixing belt and having a tip adjacent to an inner circumferential surface of the fixing belt, and is set to have a section modulus of 200 $mm^3$ or higher,
wherein the support includes a supporting portion which is perpendicular to the rising portion, the supporting portion supporting the nip forming member, and
wherein the heat source is disposed upstream of the nip portion, and disposed between a line corresponding to the supporting portion which is parallel to the nip portion and a line corresponding to the rising portion which is perpendicular to the nip portion.

18. A fixing device, comprising:
a rotatable endless fixing belt having a lateral end in a lateral direction thereof, the lateral end of the rotatable endless fixing belt being supported by a retaining member;
a nip forming member arranged inside the fixing belt;
a rotating body that abuts the nip forming member via the fixing belt to form a nip portion with the fixing belt;
a heat source that directly heats up the fixing belt at a portion other than the nip portion;
a support that supports the nip forming member;
a reflector disposed adjacent the support, the reflector covering the support without surrounding an entirety of the support; and
a slip ring disposed at the retaining member, wherein the slip ring is rotatable,
wherein the fixing device conveys a recording medium carrying an unfixed image to the nip portion between the rotating fixing belt and the rotating body to fix the unfixed image to the recording medium, and
wherein the support includes a rising portion extending in an abutting direction of the rotating body against the fixing belt, and is set to have a section modulus of 200 $mm^3$ or higher.

19. The fixing device of claim 18, wherein the support comprises a U-shape.

20. The fixing device of claim 18, wherein the fixing belt includes a base material formed of a metallic material.

21. The fixing device of claim 20, wherein the base material is formed of nickel.

22. The fixing device of claim 20, wherein the base material is formed of stainless steel.

23. The fixing device of claim 18, wherein the fixing belt includes a base material formed of resin.

24. The fixing device of claim 23, wherein the base material is formed of polyimide.

25. The fixing device of claim 18, wherein the support includes a tip adjacent to an inner circumferential surface of the fixing belt.

26. The fixing device of claim 18, wherein a contact width between the nip forming member and the support is smaller than a width of the nip forming member.

27. The fixing device of claim 18, wherein a slide sheet is disposed between the nip forming member and the fixing belt.

28. The fixing device of claim 18, wherein the nip forming member is made of resin, metal, or plastic.

29. The fixing device of claim 18, wherein the rotating body is made of expandable silicone rubber.

30. The fixing device of claim 18, wherein a diameter of the fixing belt is within 20 to 40 mm.

31. An image forming apparatus comprising the fixing device of claim 18.

32. The fixing device of claim 18, wherein the retaining member includes
a first part inserted inside the fixing belt,
a second part having an outer diameter larger than the fixing belt,
a third part that is disposed between the first part and the second part, and has an outer diameter smaller than the first part, and the slip ring is provided at the third part.

33. The fixing device of claim 18, wherein the reflector is disposed between the support and the heat source.

34. The fixing device of claim 18, wherein the reflector is disposed along the rising portion located downstream with respect to the direction of conveying the recording medium.

35. A fixing device, comprising:
a rotatable endless fixing belt having a lateral end in a lateral direction thereof, the lateral end of the rotatable endless fixing belt being supported by a retaining member;
a nip forming member arranged inside the fixing belt;
a rotating body that abuts the nip forming member via the fixing belt to form a nip portion with the fixing belt;
a heat source that directly heats up the fixing belt at a portion other than the nip portion;
a support that supports the nip forming member;

a reflector disposed adjacent the support, the reflector covering the support without surrounding an entirety of the support; and a slip ring disposed at the retaining member, wherein the slip ring is rotatable, wherein the fixing device conveys a recording medium carrying an unfixed image to the nip portion between the rotating fixing belt and the rotating body to fix the unfixed image to the recording medium, the support includes an upstream side wall located upstream with respect to a direction of conveying the recording medium, a downstream side wall opposite to the upstream side wall located downstream with respect to the direction of conveying the recording medium, and a bottom wall connecting the upstream side wall and the downstream side wall, and the bottom wall supports the nip forming member, the support has a section modulus of 200 $mm^3$ or higher, and an inner diameter of the slip ring is smaller than a diameter of the fixing belt.

36. The fixing device of claim 35, wherein the bottom wall of the support is in direct contact with the nip forming member.

37. The fixing device of claim 35, wherein the nip forming member includes a plurality of protrusions in an axis direction, and the bottom wall of the support is in contact with the plurality of protrusions.

38. The fixing device of claim 37, wherein the plurality of protrusions of the nip forming member are arranged in a plurality of rows in a cross sectional direction.

39. The fixing device of claim 35, wherein a contact width between the nip forming member and the support is smaller than a width of the nip forming member.

40. The fixing device of claim 35, wherein a slide sheet is disposed between the nip forming member and the fixing belt.

41. The fixing device of claim 35, wherein the nip forming member is made of resin, metal, or plastic.

42. The fixing device of claim 35, wherein the rotating body is made of expandable silicone rubber.

43. The fixing device of claim 35, wherein a diameter of the fixing belt is within 20 to 40 mm.

44. The fixing device of claim 35, wherein the heat source is disposed inside the upstream side wall and the downstream side wall, or inside extension lines of inner surfaces of the upstream side wall and the downstream side wall.

45. The fixing device of claim 35, wherein the upstream side wall and the downstream side wall are disposed outside a width of the nip forming member in a conveying direction of the fixing belt.

46. An image forming apparatus comprising the fixing device of claim 35.

47. The fixing device of claim 35, wherein the retaining member includes a first part inserted inside the fixing belt, a second part having an outer diameter larger than the fixing belt, a third part that is disposed between the first part and the second part, and has an outer diameter smaller than the first part, and the slip ring is provided at the third part.

48. The fixing device of claim 35, wherein the reflector is disposed between the support and the heat source.

49. The fixing device of claim 35, wherein the reflector is disposed along the downstream side wall.

* * * * *